US007329023B2

(12) United States Patent
Mast

(10) Patent No.: US 7,329,023 B2
(45) Date of Patent: Feb. 12, 2008

(54) LOW-POWER ILLUMINATION APPARATUS

(75) Inventor: Christopher R. Mast, Broadway, VA (US)

(73) Assignee: Virginia Metal Spinners, Inc, Harrisonburg, VA (US)

( * ) Notice: Subject to any disclaimer, the term of this patent is extended or adjusted under 35 U.S.C. 154(b) by 0 days.

(21) Appl. No.: 11/399,177

(22) Filed: Apr. 6, 2006

(65) Prior Publication Data

US 2006/0227562 A1 Oct. 12, 2006

Related U.S. Application Data

(60) Provisional application No. 60/669,172, filed on Apr. 7, 2005.

(51) Int. Cl.
*F21S 8/00* (2006.01)

(52) U.S. Cl. ..... 362/147; 362/392; 362/650; 362/810

(58) Field of Classification Search ..... 362/392, 362/147, 810, 649, 650, 647, 431, 410, 414
See application file for complete search history.

(56) References Cited

U.S. PATENT DOCUMENTS

| | | | | |
|---|---|---|---|---|
| 5,601,360 | A | 2/1997 | Paquette | |
| 5,829,869 | A | 11/1998 | Clegg et al. | |
| 6,224,233 | B1 * | 5/2001 | Fischer et al. | 362/147 |
| 6,264,344 | B1 * | 7/2001 | Quiogue et al. | 362/147 |
| 6,601,977 | B2 | 8/2003 | Gesue | |
| 6,837,594 | B2 | 1/2005 | Paquette et al. | |
| 6,843,580 | B2 * | 1/2005 | Fischer et al. | 362/147 |
| 2001/0009514 | A1 * | 7/2001 | Quiogue et al. | 362/368 |
| 2003/0026087 | A1 * | 2/2003 | Gesue | 362/95 |

* cited by examiner

*Primary Examiner*—Thomas M. Sember
(74) *Attorney, Agent, or Firm*—Kimberly A. Chasteen

(57) ABSTRACT

A low-power illumination apparatus is disclosed. The apparatus includes a mounting for securely mounting to a building surface in a residence or building. A light bulb socket is electrically connected to an external power source through a hollow housing which holds the socket and the electrical wiring providing the power. The housing may include decorative aspects.

10 Claims, 13 Drawing Sheets

LOW-POWER ILLUMINATION APPARATUS

CROSS REFERENCE TO RELATED APPLICATION

The present application claims priority from U.S. Provisional Application Ser. No. 60/669,172, filed Apr. 7, 2005.

BACKGROUND OF THE INVENTION

1. Field of the Invention

The present invention relates to decorative lighting fixtures, and, more particularly to a low-power lighting fixture.

2. Description of Related Art

Many devices and methods are known for illumination within residences and other buildings. In many cases, lights are desired on surfaces in buildings such as window sills, mantels or other planar surfaces. It is also known to use low-power lighting as this reduces the temperature of the light and thus, the danger of burns to people and pets and the danger of fire should the lighting be placed near flammable materials. The most common type of device used is a lamp or candle shaped light having an electrical cord which supplies power from an electrical outlet. These types of devices are often unsteady and the cords are unsightly.

U.S. Pat. No. 5,829,869 discloses a bracket for mounting these electric candles. The bracket stabilizes the candle and directs the candle's electrical cord toward an electrical outlet, hiding a portion of the cord.

Newer devices are designed to plug into outlets located in a window sill. For example, U.S. Pat. No. 6,601,977 teaches a light which simulates a candle for placement in a window sill. The device includes a plug at its terminal which is inserted into an electrical outlet in the window sill. U.S. Pat. No. 5,601,360 discloses an electrical candle which plugs into an electrical socket in a window sill. U.S. Pat. No. 6,837,594, an improvement to U.S. Pat. No. 5,601,360, discloses a low-power illumination device which plugs directly into an electrical outlet in a window sill. While these devices eliminate the electrical cord used in prior devices, they are not securely attached to the window sill as electrical plugs are easily removed from electrical outlets. The devices disclosed also do not protect against water leaking in from the window or water spillage adjacent to the electrical socket.

Of the illumination devices invented, there are none that provide a secure apparatus for mounting a low-power illumination apparatus in a window sill or other surface inside a residence or other building. Additionally, the prior art does not teach a device which protects against water leaking into a window and causing damage.

Through the details of the present invention set forth below it will be shown that the low-power illumination apparatus by its low-voltage operation and the avoidance of surface wiring provides for a safe and convenient system that minimizes the chances of accident and injury. Through the use of low-voltage, the low-power illumination apparatus may be continuously operated with power consumption held to a low level and heat dissipation held to safe levels to prevent injury to persons or pets and to prevent combustion of surrounding or proximate flammable materials. Further, the secure embedded attachment of the low-power illumination apparatus to a wood structure minimizes the chances of the low-power illumination apparatus and its attendant low-voltage wiring from being separated, thus minimizing the chance of electrical shorts from the exposed wiring. Further continuous wiring from the attachment of the low-voltage wiring to a low-voltage power source to the screws within the low-power illumination apparatus helps prevent the chances of electrical shorting and its incumbent dangers if water were to accidentally be introduced at the base of the low-power illumination apparatus. Lastly, the decorative bases which are integral structural components of the low-power illumination apparatuses may be of different materials, colors and designs to accommodate and accentuate the proximate interior design.

An object of the present invention is to provide a low-power illumination apparatus which provides a secure attachment.

An object of the present invention is to provide a low-power illumination apparatus which provides a water resistant attachment means.

An object of the present invention is to provide a low-power illumination apparatus which reduces the chance of exposed wires and the resultant dangers.

Finally, it is an object of the present invention to accomplish the foregoing objectives in a simple and cost effective manner.

SUMMARY OF THE INVENTION

The present invention addresses these needs by providing an electrically powered low-power illumination apparatus for mounting to a building surface. A hole is formed within the surface which hole securely accepts a mounting device. The mounting device is preferably scored or roughened to improve the connection between the hole and the mounting device. If desired, adhesive, nails, screws, threaded mating surfaces or other more secure means may be used. A mounting spigot is connected to the mounting device, preferably through threaded mating surfaces such that the mounting spigot is flush with the building surface and both the mounting device and spigot are contained within the hole. Both the mounting spigot and mounting device have holes through which an electrical wire may extend. The apparatus further includes a socket connected to the mounting spigot for accepting a light bulb which is electrically connected to an electrical wire so that power may be provided to the socket to light the bulb. The socket is preferably connected to the mounting spigot by means of threaded mating surfaces. A hollow housing houses the socket at the distal end such that access to the socket is provided and such that the electrical wire extends from the socket, through the housing, through the hole in the mounting spigot and through the hollow mounting device such that electrical power may be supplied to the socket. Finally, a closure device may be provided which may be secured to the mounting device upon removal of the mounting spigot.

BRIEF DESCRIPTION OF THE DRAWINGS

A more complete description of the subject matter of the present invention and the advantages thereof, can be achieved by the reference to the following detailed description by which reference is made to the accompanying drawings in which.

| Element list: | |
|---|---|
| 20 | insert chamber |
| 22 | threaded mounting device hub |
| 24 | threaded mounting device spigot |
| 26 | threaded coupling |
| 28 | threaded hollow rod |
| 29 | hollow rod with threaded ends |
| 30 | chamberbase fixture |
| 32 | candlestick pedestal |
| 34 | candelabra lamp holder |
| 36 | candle sleeve |
| 38 | low-power electric lamp |
| 40 | threaded nut |
| 42 | washer |
| 43 | wood mounting block |
| 44 | window sill |
| 45 | fireplace mantel |
| 46 | low-voltage wiring |
| 50 | sconce fixture base |
| 54 | fixture mounting arm |
| 56 | wall escutcheon plate |
| 58 | fixture mounting down rod |
| 60 | lamp base |
| 64 | low-power illumination apparatus |

DETAILED DESCRIPTION OF THE PREFERRED EMBODIMENT

The following detailed description is of the best presently contemplated mode of carrying out the invention. This description is not to be taken in a limiting sense, but is made merely for the purpose of illustrating general principles of embodiments of the invention.

As generally shown in FIGS. 1A, 1B, 2 and 3, the stable secure mounting of the low-power illumination apparatus 64 is accomplished, as will be shown below, through attachments to a mounting block which may be a window sill 44, bead board rail, fireplace mantel 45, stair casing rail, wall board, newel post, ceiling board or other similar wood component of a building structure.

Figure 1A:
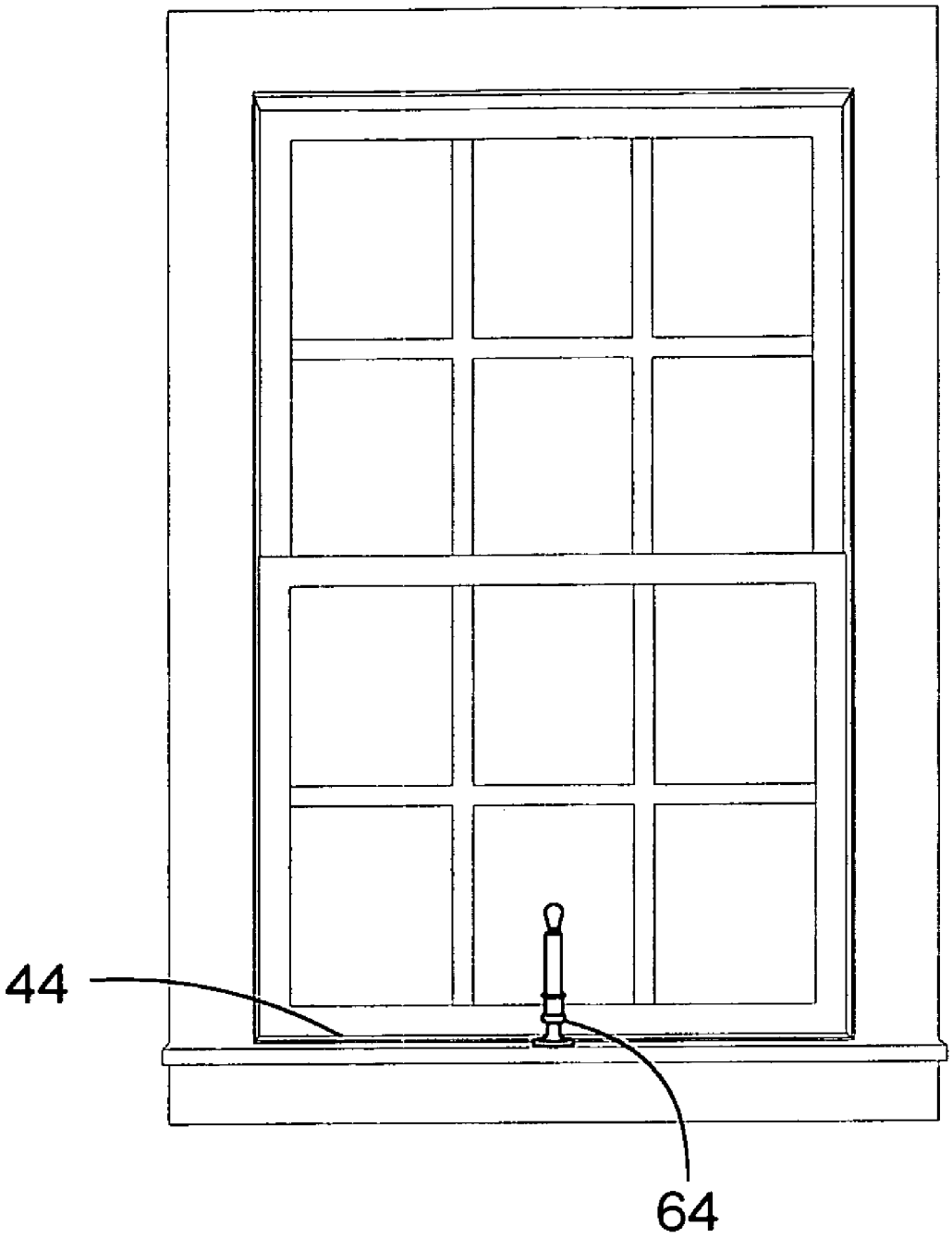
FIG. 1*a* is a perspective view of the preferred embodiment of a low-power illumination apparatus as mounted in a window sill according to the present invention.
Figure 1B:
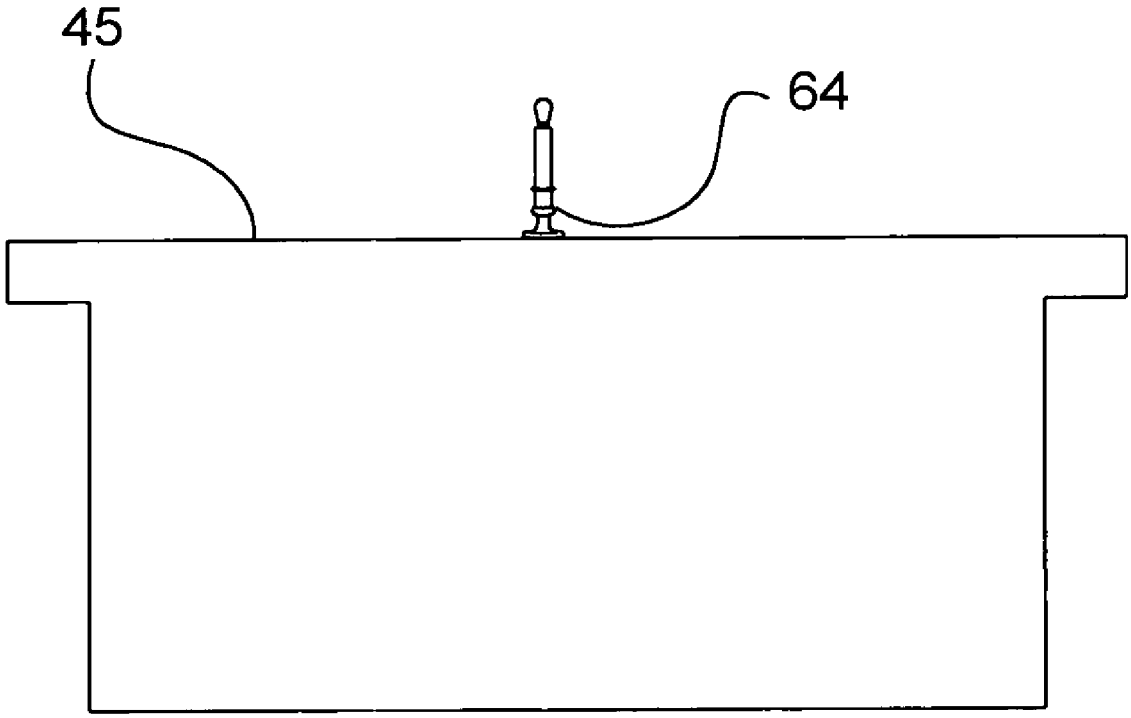
FIG. 1*b* is a perspective view of the preferred embodiment of a low-power illumination apparatus as mounted on a mantel according to the present invention.

Referring to FIGS. 1A and 1B, the low-power illumination apparatus 64 of the present invention is shown in a configuration having the appearance of a window sill 44 candle and a candle on a fireplace mantel 45 respectively. Both candles are designed to appear as though they are set upon a window sill 44 or fireplace mantel 45 where, in fact, as will be shown in paragraphs that follow, the low-power illumination apparatus 64 is fixedly attached to window sill 44 or fireplace mantel 45. The details of the electrical and mechanical attachment of the low-power illumination apparatus, as best shown in FIGS. 5 and 6, are hidden by the candlestick pedestal 32 and the candle sleeve 36.

Figure 2:
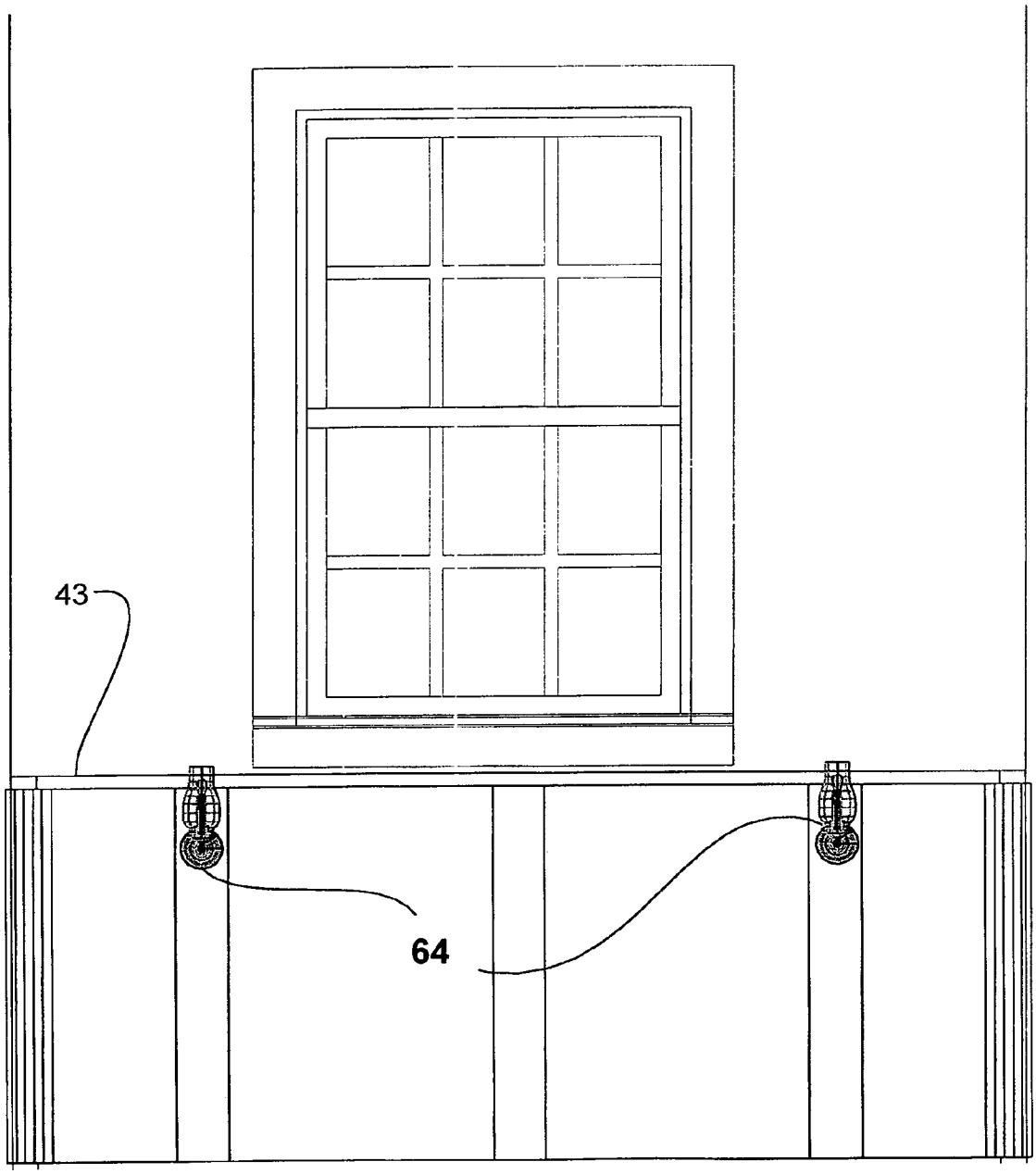
FIG. 2 is a perspective view of the preferred embodiment of a low-power illumination apparatus as mounted on a wall according to the present invention.
Figure 7:
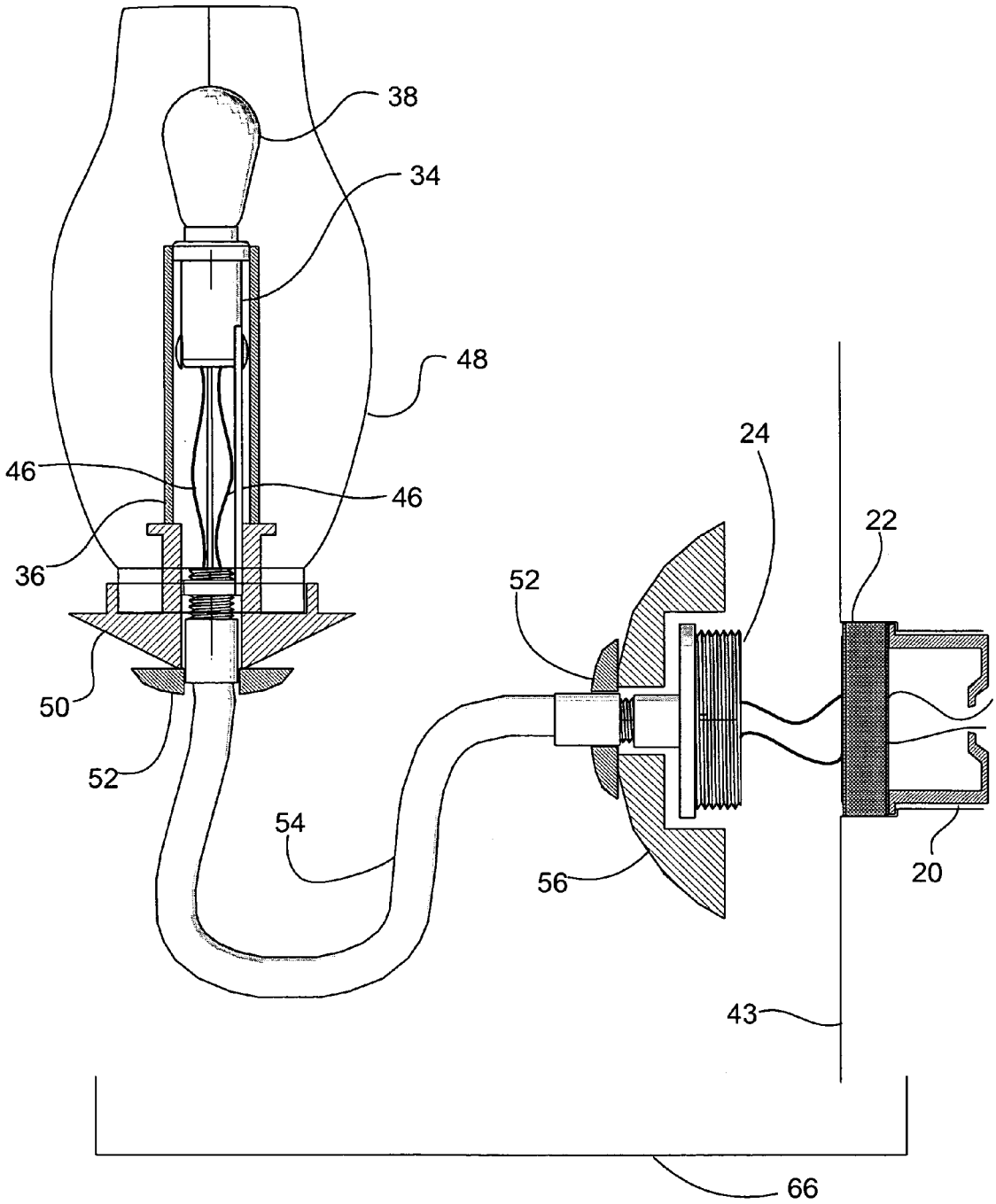
FIG. 7 is a side cross-sectional view of an alternate embodiment of a low-power illumination apparatus according to the present invention in the uninstalled orientation.

In another embodiment as shown in FIG. 2, the low-power illumination apparatus 64 of the present invention is shown in the configuration having the appearance of a wall mounted sconce fixture, which is fixedly attached as shown in FIG. 7 to wood mounting block 43. The details of the electrical and mechanical attachment of the low-power illumination apparatus 64, as best shown in FIG. 7, are hidden by the wall escutcheon plate 56, fixture mounting arm 54, sconce fixture base 50 and candle sleeve 36.

Figure 3:
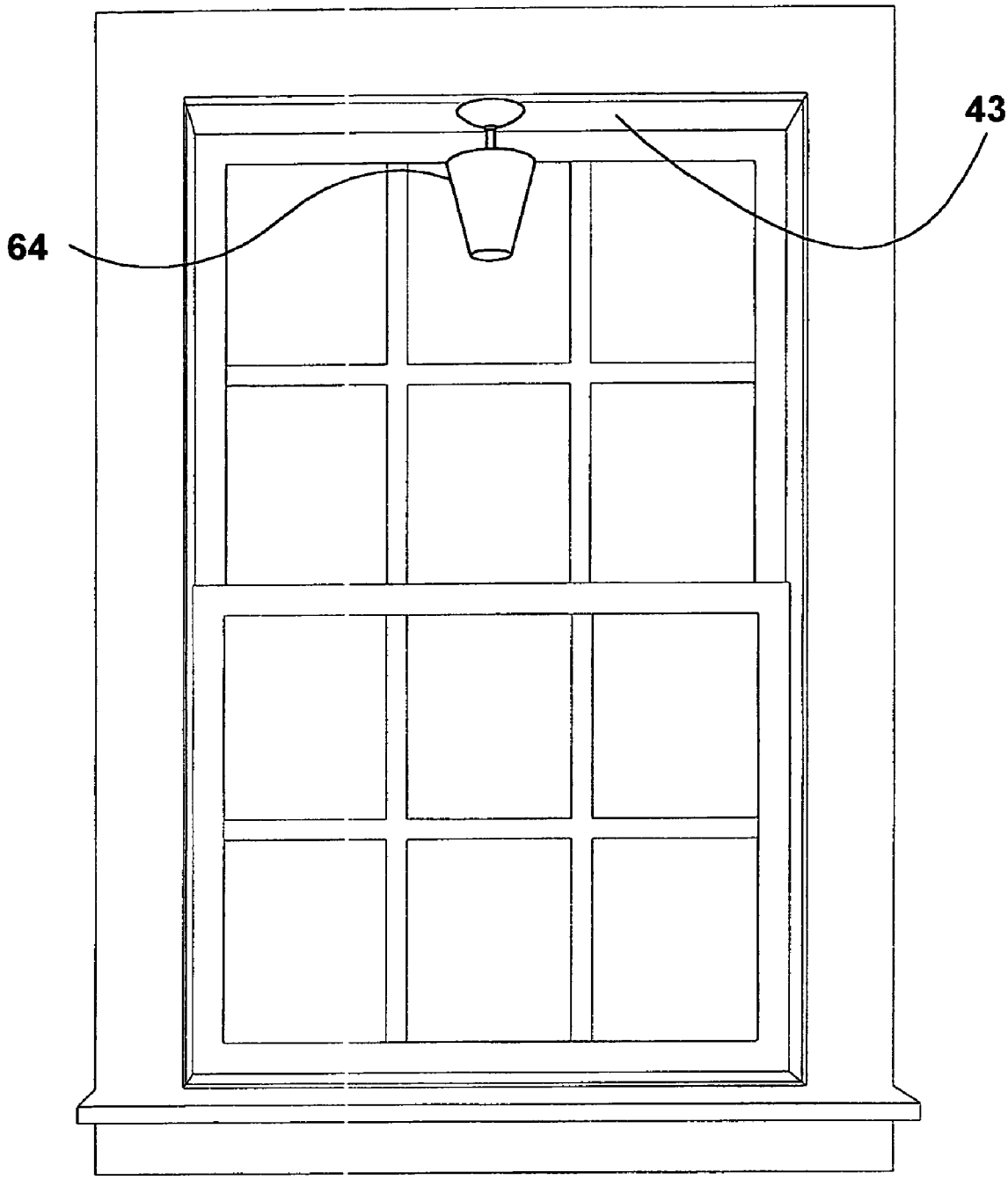
FIG. 3 is a perspective view of the preferred embodiment of a low-power illumination apparatus as mounted in a window sill according to the present invention.
Figure 8:
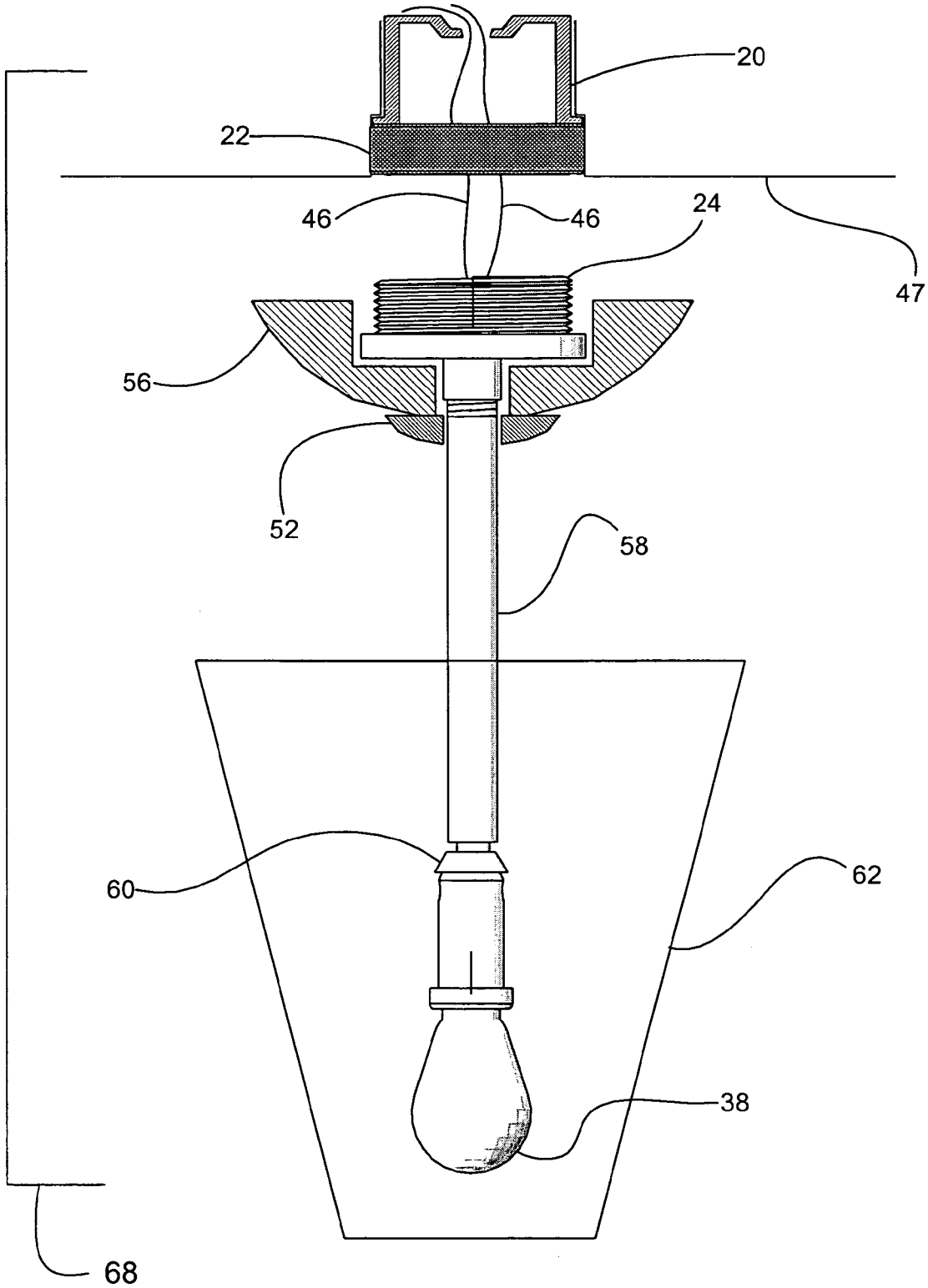
FIG. 8 is a view of an alternate embodiment of the present invention.

In another embodiment as shown in FIG. 3, the low-power illumination apparatus 64 of the present invention is shown in the configuration of a fixture assembly with overhead mount which is fixedly attached as shown in FIG. 8 to wood mounting block 43. The details of the electrical and mechanical attachment of the low-power illumination apparatus 64, as best shown in FIG. 8, are hidden by the wall escutcheon plate 56, the fixture mounting down rod 58 and lamp base 60.

Figure 4:
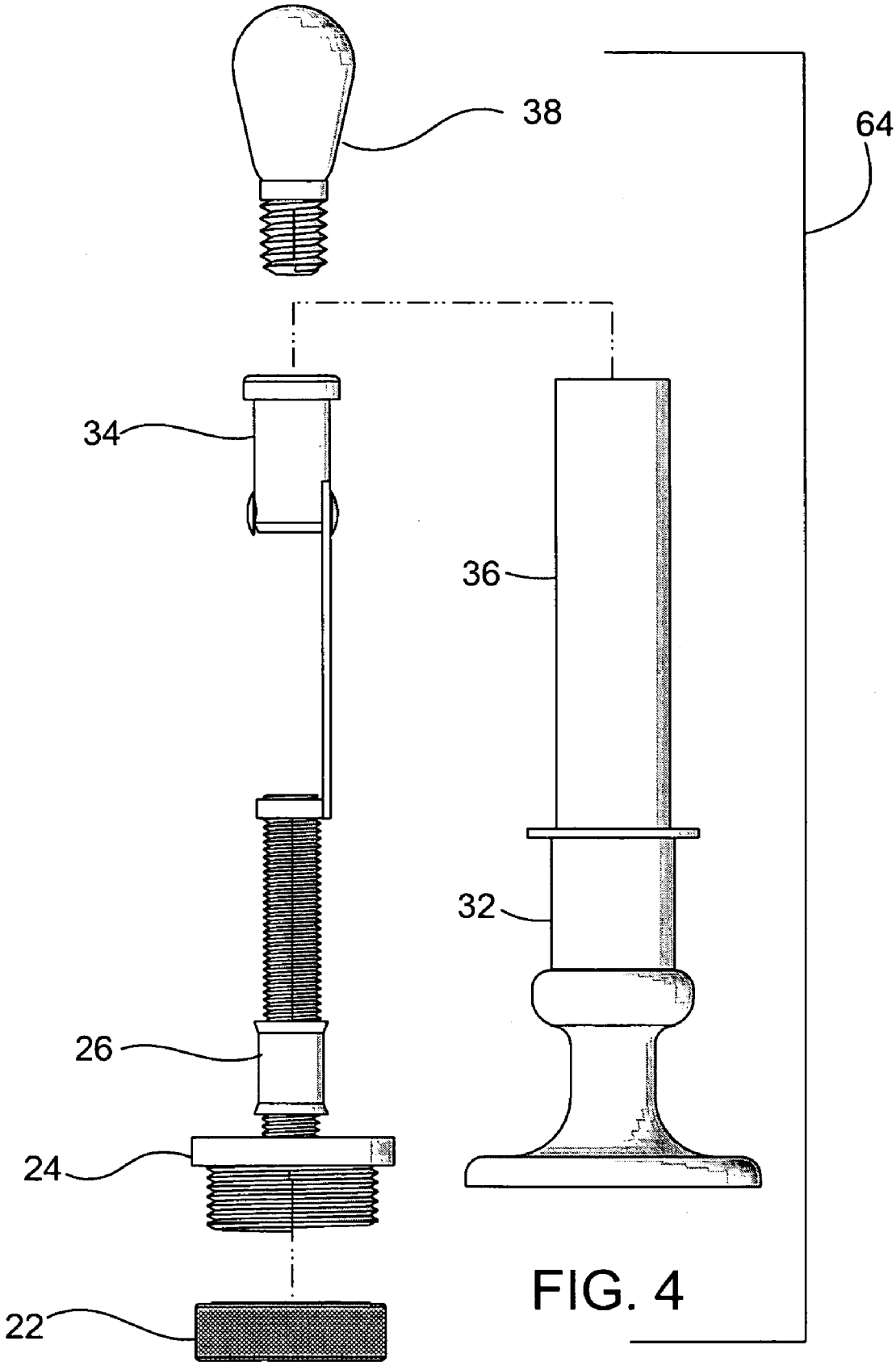
FIG. 4 is an exploded side view of the preferred embodiment of a low-power illumination apparatus according to the present invention.
Figure 5:
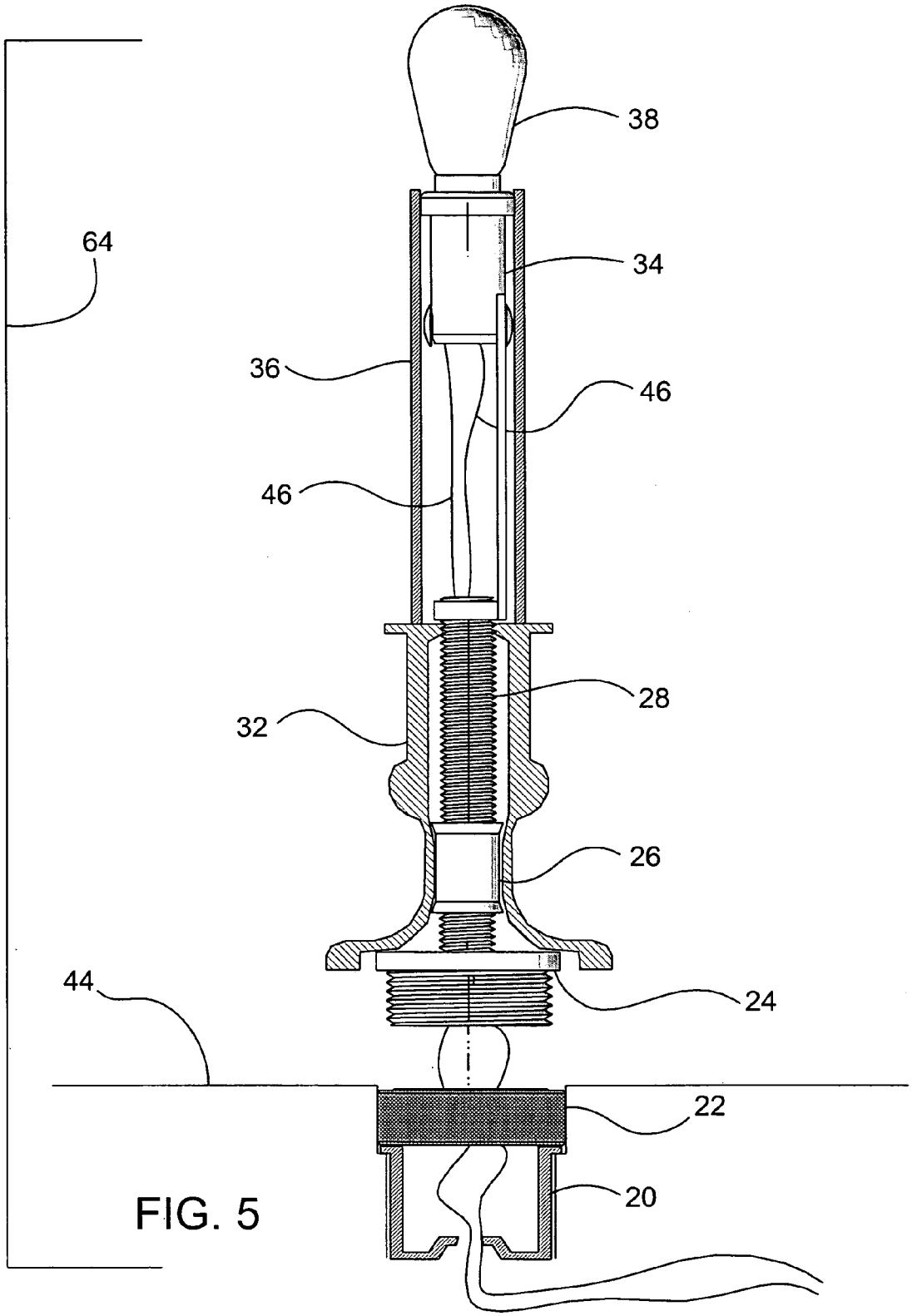
FIG. 5 is a side cross-sectional view of the preferred embodiment of a low-power illumination apparatus according to the present invention in the uninstalled orientation.
Figure 6:
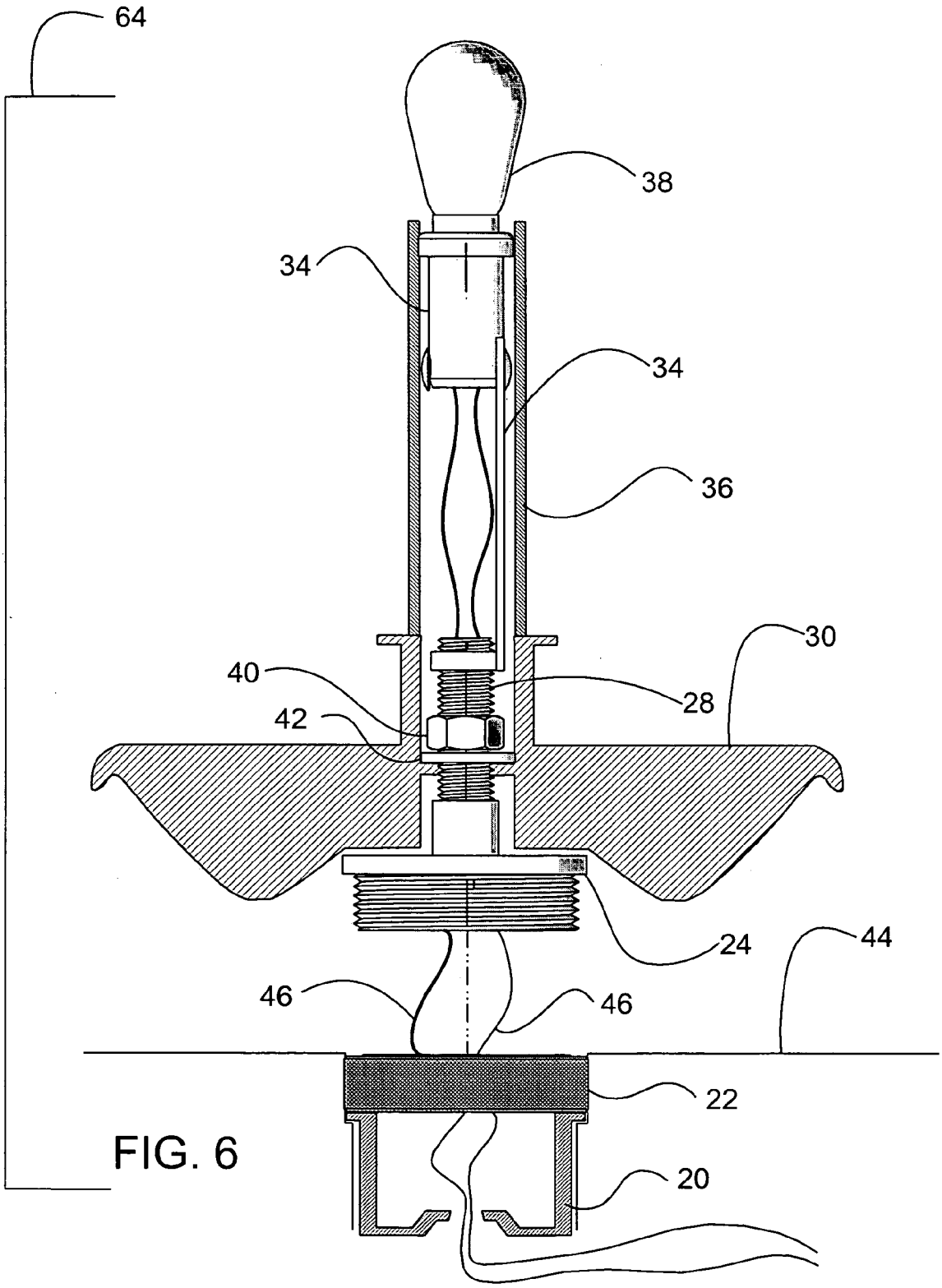
FIG. 6 is a side cross-sectional view of an alternate embodiment of a low-power illumination apparatus according to the present invention in the uninstalled orientation.

The low-power illumination apparatus 64 illustrated in FIGS. 1A and 1B as a window candle having details best shown in FIGS. 5 and 6 includes a candelabra lamp holder 34 inside the candle sleeve 36 having coupled thereto a low-power electric lamp 38 which is supplied electrical power via low-voltage wiring 46. The low-voltage wiring 46 is to be coupled to a low-voltage power source (not shown) such as a 12 VDC, 12 VAC or other low-voltage power source. The low-voltage power source could be incorporated into a control panel (not shown) which could include a time clock such that the time would automatically turn on and off the electric candle or a rechargeable battery as a back-up in the event of main power failure. The control panel could also be configured so that multiple low-power illumination apparatuses 64 could be grouped for control purposes so lights in individual rooms or in certain exterior windows could be turned on and off as a group. Low-power lamp 38 is preferably a low-wattage incandescent bulb, and may be formed in the shape of a candle flame or any other desired configuration. The bulb is threadably inserted into a lamp socket which is part of the candelabra lamp holder 34 (shown in FIGS. 4, 5 and 7) or into a lamp base 60 (shown in FIG. 8) and may thereby be interchanged with bulbs of different shapes. In the preferred embodiment of the invention, low-power lamp 38 is a 3 W to 6 W incandescent bulb driven by the low-voltage power source in order that the invention may be continuously operated with power consumption held to a low level and heat dissipation held to safe levels to prevent injury to persons or pets and prevent combustion of surrounding or proximate flammable materials. Several such low-power illumination apparatuses 64 may be separately wired to achieve a desired decorative effect. Alternatively, multiple apparatuses of the various embodiments of the present invention may be placed throughout a dwelling or other building to provide low levels of light at night as in windows or darkened stairways and hallways. When controlled by a central control panel containing a battery back-up or alternate power source, the apparatuses could also function as minimal lighting in the event of main power failure.

Low-voltage wiring 46 is routed from each low-power illumination apparatus 64 through the walls of the building or structure to the low-voltage power source (not shown) to provide electrical power separately to each low-power illumination apparatus 64. As best shown in FIGS. 5, 6 and 7, the low-voltage wiring 46 is pulled through insert chamber 20, through the hole in the center of threaded mounting device hub 22, through the hollow center of threaded mounting device spigot 24 and hence through either the threaded coupling 26, the threaded hollow rod 28, the hollow rod with threaded ends 29 (FIG. 11) or the fixture mounting down rod 58 (FIG. 8). The low-voltage wiring 46 is then fixedly attached to low-voltage electrical attachments on the candelabra lamp holder 34 (FIGS. 5, 6 and 7) or in the lamp base 60 (FIG. 8). As illustrated in FIGS. 5, 7 and 8 and best shown in FIGS. 9, 10 and 11, holes are drilled in the window sill 44 (or, as desired, the mounting block 43 or the fireplace mantel 45) to a size specification to, in the preferred embodiment, accommodate insert chamber 20 which is preferably made of an inflammable, flexible, supportive, non-conductive material such as rubber and additionally to a size specification required so that the threaded mounting device 22, which preferably includes a scored or roughened outer surface, must be forcibly inserted into the hole causing its rough outer surface to bind and grip the exposed wood of the hole in the window sill 44 thus creating a mechanical coupling point for threaded mounting device spigot 24 which will securely maintain the upright, horizontal or hanging embodiments of the present invention. Alternately, threaded mounting device hub 22 could be secured in the hole by use of glue, a threaded base, set-screws or other secure means. The depth of the drilled hole in the window sill 44 to receive the threaded mounting device hub 22 shall be of the precise depth such that the exposed top edge of the threaded mounting device hub 22 shall be below the plane of the surface of the window sill 44 such that the top surface of the threaded mounting device spigot 24 is preferably flush with the window sill 44 when installed.

Figure 12:
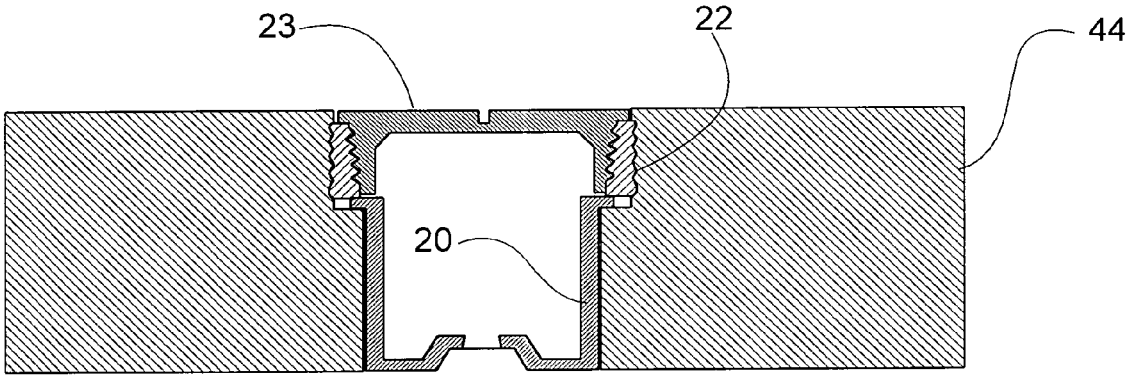
FIG. 12 is a cross-sectional view of the mounting system of the preferred embodiment of the present invention in the closed and sealed orientation.

As shown in FIG. 12, flush mounted decorative plug 23 may be inserted into threaded mounting device hub 22 in the event that the low-power illumination apparatus 64 is removed. As previously described, the depth of the drilled hole in the window sill 44 to receive threaded mounting device hub 22 shall be of the precise depth such that the exposed top edge of threaded mounting device hub 22 shall be below the plane of the surface of the window sill 44 such that the top surface of flush mounted decorative plug 23 shall be flush with the window sill 44 when installed. As shown in FIG. 12, the low-voltage wiring 46, once disconnected from the low-voltage power supply (not shown), may be disconnected from the candelabra lamp holder 34 (FIGS. 5, 6 and 7) or the lamp base 60 (FIG. 8) and coiled and stored in the insert chamber 20.

Figure 9:
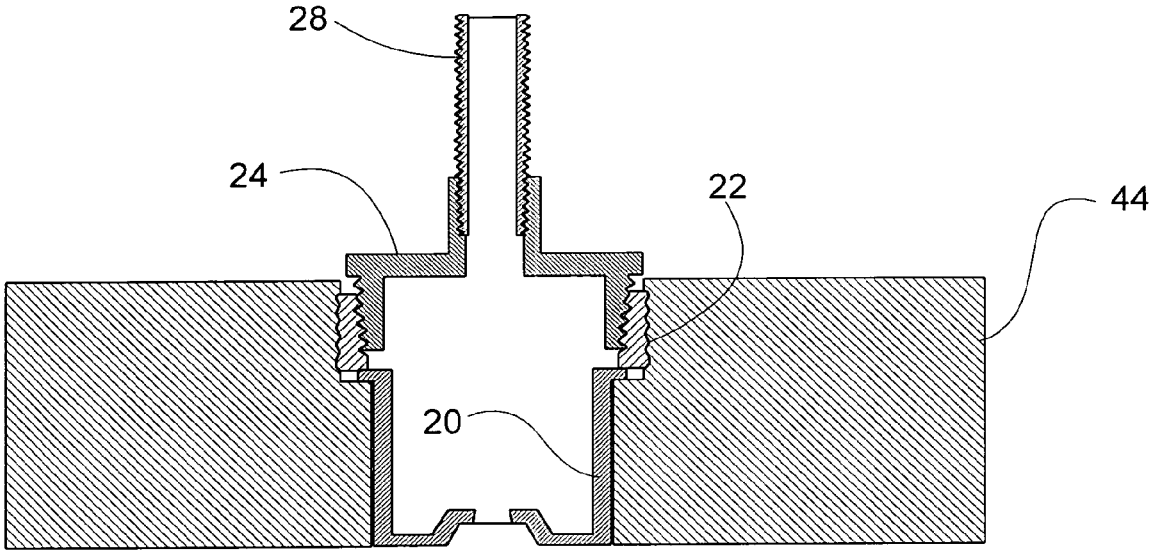
FIG. 9 is a cross-sectional view of the mounting system of the preferred embodiment of the present invention.
Figure 10:
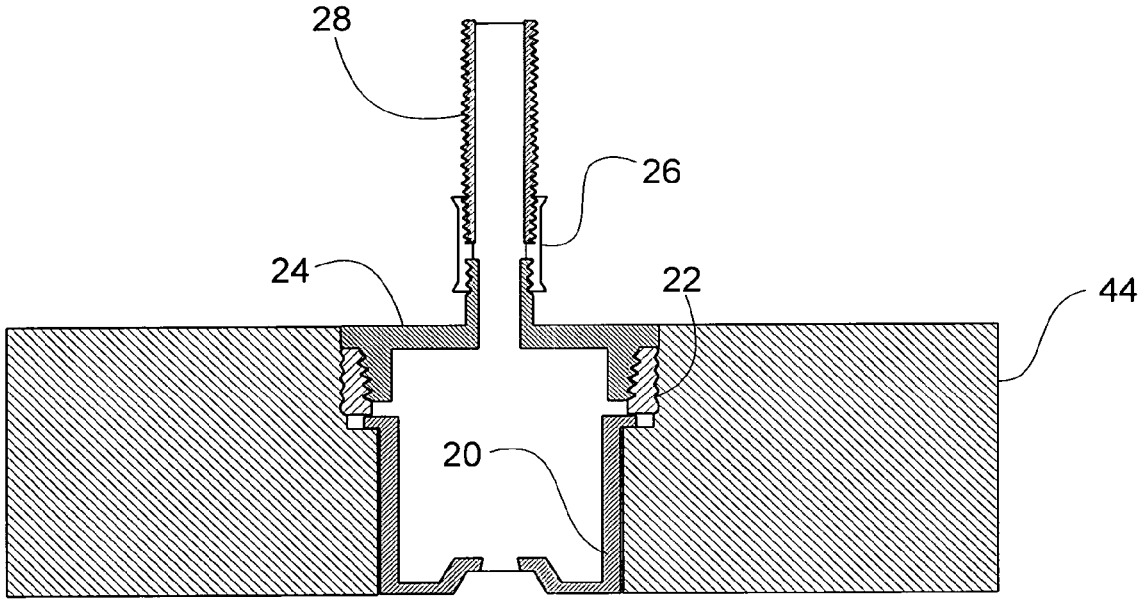
FIG. 10 is a cross-sectional view of the mounting system of an alternate embodiment of the present invention.
Figure 11:
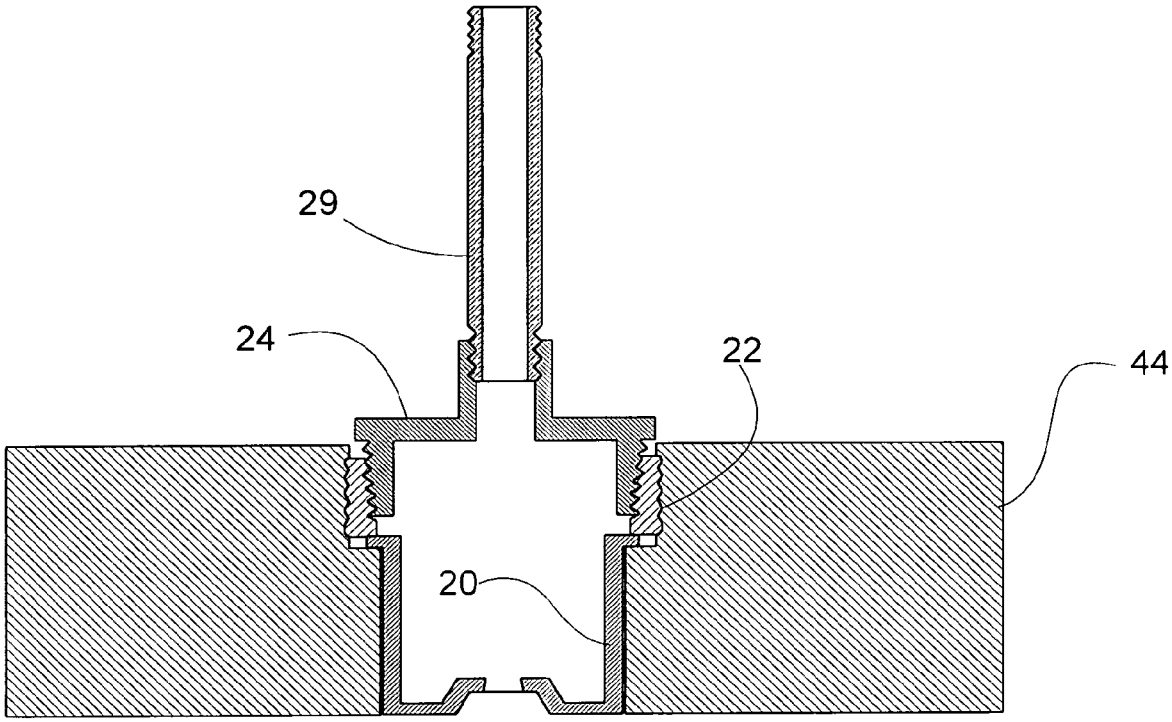
FIG. 11 is a cross-sectional view of the mounting system of an alternate embodiment of the present invention.

In order to accommodate various base designs such as a candlestick pedestal 32, a chamberbase fixture 30 or a wall escutcheon plate 56, illustrated in FIGS. 5, 6, 7 and 8 and best shown in FIGS. 9, 10 and 11, the threaded mounting device 24 may have a female threaded opening to accommodate a threaded hollow rod 28 (FIG. 9) or a hollow rod 29 with threaded ends (FIG. 11) or a fixture mounting down rod 58 (FIG. 8). Alternatively, the threaded mounting device 24 may have a male threaded opening to accommodate a threaded hollow rod 28 (FIG. 9) used in conjunction with a threaded coupling 26 (FIG. 10). All of these embodiments provide for the secure attachment of and linking together of the various base embodiments to the candelabra lamp holder 34 (FIGS. 5, 6 and 7) or the lamp base 60 (FIG. 8) and to the threaded mounting device spigot 24. Alternatively, as shown in FIG. 6, a threaded nut 40 and a washer 42 may be used in conjunction with a threaded hollow rod 28 to securely fasten the chamber base embodiment to a threaded mounting device spigot 24.

It will be appreciated by those skilled in the art that there may be many combinations of a candlestick pedestal 32 (FIG. 5), a chamberbase fixture 30 (FIG. 6), a wall escutcheon plate 56 (FIGS. 7 and 8) or other similar embodiments and the various attachment mechanisms in the form of a threaded hollow rod 28 (FIGS. 5 and 6), a fixture mounting arm 54 (FIG. 7), a fixture mounting down rod (FIG. 8) or other similar embodiment which are dependent on the exact design of the bases and fixtures.

The tubular body 36 can be made of different materials and in different colors and designs to accommodate holiday or seasonal themes or the proximate interior design to aid in flexibility of use. As described above, the low-power illumination apparatus of the present invention by its low-voltage operation and the avoidance of surface wiring provides for a safe and convenient system that minimizes the chances of accident and injury. Further, in its embodiment as illustrated in FIGS. 1A and 1B and best shown in FIGS. 5 and 6, the secure embedded attachment of the chamberbase fixture 30, the candlestick pedestal 32 or any similar decorative base to a mounting block such as a window sill 44 minimizes the chances of the low-power illumination apparatus and its attendant low-voltage wiring 46 from being separated, thus minimizing the chance of electrical shorts from the exposed wiring. Further the attachment of the low-voltage wiring 46 to the screws on the candelabra lamp holder 34 prevent the chances of electrical shorting and its incumbent dangers if water were to accidentally be introduced to insert chamber 20.

Obviously, many modifications may be made without departing from the basic spirit of the present invention. Accordingly, it will be appreciated by those skilled in the art that within the scope of the appended claims, the inventions may be practiced other than has been specifically described herein. Many improvements, modifications, and additions will be apparent to the skilled artisan without departing from the spirit and scope of the present invention as described herein and defined in the following claims.

What is claimed is:

1. An electrically powered low-power illumination apparatus for mounting to a building surface, comprising:

a hollow mounting device securely placed within a hole formed in the building surface such that the mounting device is contained within the hole, wherein the internal surface of the hollow mounting device is threaded;

a mounting spigot having a hole through which an electrical wire may extend and adapted to be removably secured to the mounting device, wherein the external surface of the mounting spigot is threaded such that the mounting spigot may be threaded into the hollow mounting device;

a socket for accepting a light bulb, the socket being electrically connected to an electrical wire;

a connection means for connecting the socket to the mounting spigot; and a hollow housing for housing the socket at the distal end such that access to the socket is provided and such that the electrical wire extends from the socket, through the housing, through the hole in the mounting spigot through the hollow mounting device and to an external electrical power supply in a continuous fashion such that electrical power may be supplied directly to the socket; wherein the internal surface of the hollow mounting device is threaded and the external surface of the mounting spigot is threaded such that the mounting spigot may be threaded into the hollow mounting device.

2. An electrically powered low-power illumination apparatus for mounting to a building surface, comprising:

a hollow mounting device securely placed within a hole formed in the building surface such that the mounting device is contained within the hole;

a mounting spigot having a hole through which an electrical wire may extend and adapted to be removably secured to the mounting device;

a socket for accepting a light bulb, the socket being electrically connected to an electrical wire;

a connection means for connecting the socket to the mounting spigot, wherein the connection means is a hollow rod having a threaded external surface; and a hollow housing for housing the socket at the distal end such that access to the socket is provided and such that the electrical wire extends from the socket, through the housing, through the hole in the mounting spigot through the hollow mounting device and to an external electrical power supply in a continuous fashion such that electrical power may be supplied directly to the socket and wherein the connection means is placed within the housing.

3. The low-power illumination apparatus as set forth in claim 2 wherein the mounting spigot includes hole with an internally threaded surface which accepts the hollow rod.

4. The low-power illumination apparatus as set forth in claim 2 wherein the flexible mounting spigot includes an upwardly extending element with an internally threaded surface which accepts the hollow rod.

5. The low-power illumination apparatus as set forth in claim 2 wherein the hollow rod is connected to the socket by a holder element threaded onto the hollow rod and situated within the hollow housing.

6. An electrically powered low-power illumination apparatus for mounting to a building surface, comprising:

a hollow mounting device securely placed within a hole formed in the building surface such that the mounting device is contained within the hole, and wherein the internal surface of the hollow mounting device is threaded;

a mounting spigot having a hole through which an electrical wire may extend and adapted to be removably secured to the mounting device and wherein the external surface of the mounting spigot is threaded such that the mounting spigot may be threaded into the hollow mounting device;

a socket for accepting a light bulb, the socket being electrically connected to an electrical wire;

a connection means for connecting the socket to the mounting spigot; and a hollow housing for housing the socket at the distal end such that access to the socket is provided and such that the electrical wire extends from the socket, through the housing, through the hole in the mounting spigot and through the hollow mounting device such that electrical power may be supplied to the socket.

7. The low-power illumination apparatus as set forth in claim 6 wherein the connection means is a hollow rod which is placed within the housing and wherein the external surface of the hollow rod is threaded.

8. The low-power illumination apparatus as set forth in claim 7 wherein the mounting spigot includes hole with an internally threaded surface which accepts the hollow rod.

9. The low-power illumination apparatus as set forth in claim 7 wherein the flexible mounting spigot includes an upwardly extending element with an internally threaded surface which accepts the hollow rod.

10. The low-power illumination apparatus as set forth in claim 7 wherein the hollow rod is connected to the socket by a holder element threaded onto the hollow rod and situated within the hollow housing.

* * * * *